US008888394B2

(12) United States Patent
Caulier

(10) Patent No.: US 8,888,394 B2
(45) Date of Patent: Nov. 18, 2014

(54) DEVICE INCLUDING A ROTARY APPLICATOR MEMBER WITH AT LEAST ONE DISPENSER ORIFICE THAT OPENS UNDER PRESSURE FROM THE COMPOSITION

(75) Inventor: Eric Caulier, Maignelay (FR)

(73) Assignee: L'Oreal, Paris (FR)

( * ) Notice: Subject to any disclaimer, the term of this patent is extended or adjusted under 35 U.S.C. 154(b) by 1138 days.

(21) Appl. No.: 12/702,851

(22) Filed: Feb. 9, 2010

(65) Prior Publication Data

US 2010/0239356 A1 Sep. 23, 2010

Related U.S. Application Data

(60) Provisional application No. 61/159,221, filed on Mar. 11, 2009.

(30) Foreign Application Priority Data

Feb. 11, 2009 (FR) ..... 09 00592

(51) Int. Cl.
*B43M 11/02* (2006.01)

(52) U.S. Cl.
USPC ..... 401/219

(58) Field of Classification Search
CPC ..... A45D 34/04; A45D 34/041; B05C 17/03; B05C 17/0308; B05C 17/0316
USPC ..... 401/197, 208, 219, 220
See application file for complete search history.

(56) References Cited

U.S. PATENT DOCUMENTS

| | | | | |
|---|---|---|---|---|
| 673,960 | A * | 5/1901 | Looker | 401/197 |
| 1,264,666 | A * | 4/1918 | Ljungstrom | 401/219 |
| 2,860,359 | A * | 11/1958 | James | 401/183 |
| 3,268,943 | A | 8/1966 | Melnyck | |
| 3,319,837 | A * | 5/1967 | Mueller | 222/212 |
| 3,702,739 | A | 11/1972 | Rentfrow | |
| 6,742,950 | B1 * | 6/2004 | Coombs | 401/23 |
| 7,101,106 | B1 * | 9/2006 | Wiley | 401/210 |
| 7,153,053 | B1 | 12/2006 | Wiley | |
| 7,435,029 | B1 | 10/2008 | Marini | |
| 2007/0127980 | A1 | 6/2007 | Tamez | |

FOREIGN PATENT DOCUMENTS

| | | | |
|---|---|---|---|
| CH | 595 888 | A5 | 2/1978 |
| DE | 34 47 845 | A1 | 7/1986 |
| DE | 34 47 856 | A1 | 7/1986 |
| EP | 0 079 044 | A1 | 5/1983 |
| FR | 1 164 203 | | 10/1958 |
| FR | 2 596 674 | A1 | 10/1987 |
| FR | 2 640 414 | A1 | 6/1990 |
| WO | WO 92/04842 | A1 | 4/1992 |

OTHER PUBLICATIONS

French Search Report issued in French Patent Application No. 0900592 on Dec. 8, 2009 (with translation).

* cited by examiner

*Primary Examiner* — Huyen Le
(74) *Attorney, Agent, or Firm* — Oliff PLC

(57) ABSTRACT

A device for packaging and applying a liquid composition, the device comprising:

a container containing the composition; and a rotary applicator member having at least one dispenser orifice configured to open when the upstream composition is put under sufficient pressure, and to close when the pressure decreases.

16 Claims, 5 Drawing Sheets

DEVICE INCLUDING A ROTARY APPLICATOR MEMBER WITH AT LEAST ONE DISPENSER ORIFICE THAT OPENS UNDER PRESSURE FROM THE COMPOSITION

FIELD OF THE INVENTION

The present invention relates to packaging and applicator devices that include a rotary applicator member.

BACKGROUND OF THE INVENTION

Numerous devices that include an applicator roller are already known.

Thus, publication EP 0 079 044 describes a device in which the roller is mounted in a housing that extends between two uprights of an applicator head that is screwed onto the neck of a container. The roller acts as a shutter member relative to the composition passing through the neck. With such a device, it is relatively difficult to control the flow of composition, since the tighter the roller is mounted in the housing of the applicator head, the greater the resulting sealing in the absence of use, but the more difficult it is to turn the roller.

Application FR 2 640 414 discloses a device in which the composition is delivered to the applicator roller by a bent tube and it is dispensed within the roller by orifices in the tube. The appearance of that device recalls the appearance of a roller for applying paint. In addition, the bent tube needs to withstand the mechanical stresses that are encountered during application, thereby making it difficult for it to be fabricated out of a material that is not a metal.

Analogous devices for applying paint are described in the following patents: U.S. Pat. No. 3,702,739; U.S. Pat. No. 3,268,943; and FR 1 164 203.

Application WO 92/04842 discloses a device in which the applicator roller turns about an axis of rotation that is at an angle relative to the longitudinal axis of the container.

Application DE 34 47 845 describes a device for applying a care product, the device comprising a porous applicator roller within which the care product is dispensed by a perforated tube.

There exists a need to benefit from a device that enables the quantity of composition that is dispensed to be controlled easily, and that can be cleaned easily.

OBJECT AND SUMMARY OF THE INVENTION

The invention seeks in particular to satisfy this need, and exemplary embodiments of the invention achieve this object in particular by means of a device for packaging and applying a liquid composition, the device comprising:

- a container containing the composition; and
- a rotary applicator member having at least one dispenser orifice configured to open when the upstream composition is put under sufficient pressure, and to close when the pressure decreases.

The invention makes it possible to benefit from a device that is easy to use and to clean. Furthermore, the device may be made in such a manner as to enable the user to see the composition leave via one or more dispenser orifices, thereby making it easier to determine the quantity that is dispensed.

The device may include an applicator head which is connected with the container. The applicator head may comprise the rotary applicator member.

The rotary applicator member may communicate with the container via a duct that is formed, over at least a fraction of its length, by assembling together at least two parts of the applicator head. This enables the device to be made compact and pleasing in appearance.

The assembly of the parts together may be done without fitting of one part into the other one along an axis parallel to the flow direction of the composition. The parts may be flat-fastened against each other, for instance.

The fraction of the duct that is formed in each of the parts may be formed as a recess in a face for assembling with the other part. Molding of each fraction of the duct may therefore be made easier, even with a curvilinear axis.

Said fraction, or even the whole duct, may have a cross section having an outline defined by at least two parts.

Each of the parts may be stationary relative to the other one at any time during the service life of the device.

The duct may be completely hidden within the applicator head, thereby improving its appearance. This may also serve to avoid subjecting the duct to high levels of mechanical stress in use, and it is possible for the parts constituting the duct to be made out of thermoplastic material.

The axis of rotation may be perpendicular to the longitudinal axis of the container, thus making the device ergonomical and practical to use.

The outside surface of the applicator member may be relatively smooth, thereby making it easier to clean.

The applicator member may be fed internally by the above-mentioned duct, the applicator member then being hollow. By way of example, the applicator member may present a blind housing communicating with the duct.

In exemplary embodiments, the applicator may be monolithic, made of a single material.

At least one channel, for example radial, communicating with a dispenser orifice may open out into the blind housing.

The above-mentioned fraction of the duct that is formed by assembling together parts of the applicator head may extend between an end of the duct adjacent to the applicator member and an end of the duct adjacent to a neck of the container. Said fraction may describe at least one bend, e.g. a bend through substantially 180°.

The device may include an endpiece about which the applicator member is capable of turning, in particular an endpiece formed by assembling together the two above-mentioned parts of the applicator head. A portion of the duct may thus be formed by such an endpiece.

The applicator member may include a body of elastically deformable material, e.g. of elastomer, having rings engaged therein, which rings may be made of a material that is not an elastomer, e.g. a polyolefin such as polypropylene or polyacetal (POM).

The elastically deformable material may be impermeable to liquids, e.g. being not porous. It is made for example of a material not comprising interconnected open cells in every direction, and it can be non cellular.

The device may include a shutter that is movable relative to the container between a shut position in which it closes communication between the duct and the container, and a dispensing position in which it reestablishes said communication.

The container may include a neck having an insert mounted therein and the shutter may include a tubular skirt engaged in the insert, the insert having an annular lip that bears against the skirt of the shutter. The presence of the lip may serve to guarantee sealing between the shutter and the neck, without jamming, even after the device has been used and composition is present on the contacting surfaces.

The applicator head may be movable relative to the container, in particular it may be capable of being turned relative thereto, in particular about its longitudinal axis. Movement of the applicator head relative to the container may cause the shutter to move, causing it to pass from a shut position closing communication between the dispenser orifice(s) and the container, to an open position, and vice versa.

The applicator head may include two uprights between which the applicator member turns.

In exemplary embodiments, the applicator member may freely rotate, e.g. about a rotational axis that is oblique or perpendicular to a longitudinal axis of the device.

The applicator member may include channels, each of which having a longitudinal axis, especially radial channels enabling the composition to be taken to the surface of the applicator member.

The channel(s), for example radial, may be made through a single material and may open out, from one hand, onto the radially outer surface of the applicator member and, from an other hand, into a cavity of the applicator member which is common to all the channels. Said cavity may be for example the blind housing above-mentioned.

The channel(s) may cross from one end to another a single material and they may have a cross section that may be constant or not.

Said material may be for example the elastically deformable material above-mentioned.

The container may have a flexible wall. The user may press against said wall to apply pressure to the composition and force it to be dispensed through the dispenser orifice(s).

The applicator member may include one or more dispenser orifices configured to open when the composition upstream therefrom is put under sufficient pressure, and to close when the pressure decreases.

When switching from a configuration in which the dispenser orifice(s) is at rest to a configuration in which it is crossed by the composition under pressure, the dispenser orifice may have its cross section expanded, for example homogeneously, of at least 10%, at least 50%, even at least 100%, relative to the cross section at rest.

The or each dispenser orifice may be defined by a hole through an elastically deformable wall of the applicator member, the hole being of section that is sufficiently small, in the absence of deformation of the applicator member, to oppose the composition flowing therethrough under gravity. The closure of the orifice(s) may also suffice to prevent the composition drying out within the applicator member and to limit penetration of external bodies, e.g. water when the applicator member is rinsed. The diameter of the orifice(s) at rest may be less than or equal to 1 millimeter (mm), e.g. lying in the range 0.4 mm to 0.6 mm.

The channel(s) and/or the orifice(s) may be mechanically made, e.g. by machining or by molding.

The channel(s) feeding the orifice(s) may extend in a portion of the applicator member made of a material impermeable to liquids, possibly non-porous.

In variant exemplary embodiments, the or each orifice is fitted with a valve.

The number of dispenser orifices present in the applicator member may lie in the range three to 50, for example.

The orifice(s) may extend solely in a middle region of the applicator member. The orifice(s) may be disposed in one or more annular rows, e.g. in one to ten rows, the orifices being uniformly distributed angularly within each row, for example, and with each row including three to 12 orifices, for example.

The device may include an extension that is stationary relative to the container, located inside the applicator member and configured to close the channels feeding the orifices with composition, the extension having a predefined orientation relative to the container.

In variant exemplary embodiments, the device comprises an external sleeve, for instance made in a cellular material, e.g. foam, said sleeve being engaged on the remainder of the applicator member and being retained on it, by example, by friction. Such a sleeve can help spreading the product and/or reduce the risk of sliding without rotation, for instance.

The orifice(s) may be visible or not by the user, being for example partly hidden, otherwise totally hidden, under the sleeve.

Thickness of the sleeve may be less than that of the underlying body, e.g. less than half of the thickness of the underlying body.

The orifice(s) open out, when such a sleeve is present, under the sleeve.

Other exemplary embodiments of the invention also provide a method of fabricating a device as defined above, the orifice(s) of the applicator member being made by piercing the applicator member while in an expanded state, such that on the applicator member returning to its initial shape by elasticity, the section of the or each orifice is reduced.

BRIEF DESCRIPTION OF THE DRAWINGS

The invention can be better understood on reading the following detailed description of non-limiting embodiments thereof, and on examining the accompanying drawings, in which.

MORE DETAILED DESCRIPTION

Figure 1:
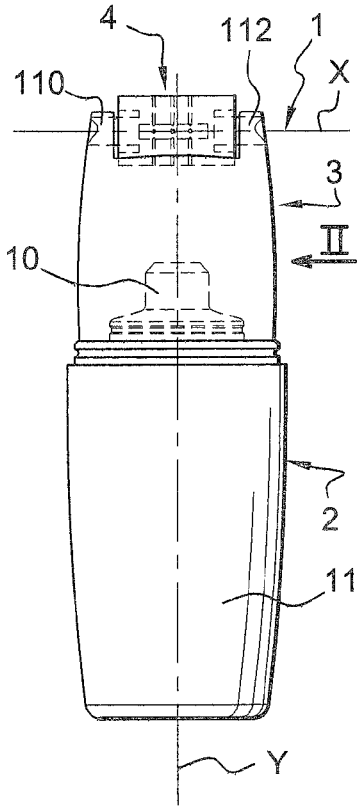
FIG. 1 is a fragmentary and diagrammatic elevation view of an embodiment of the packaging and applicator device made in accordance with the invention.
Figure 2:
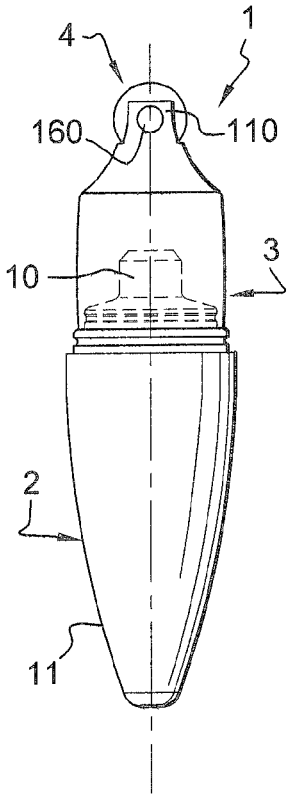
FIG. 2 is a side view as seen looking along II of FIG. 1.
Figure 3:
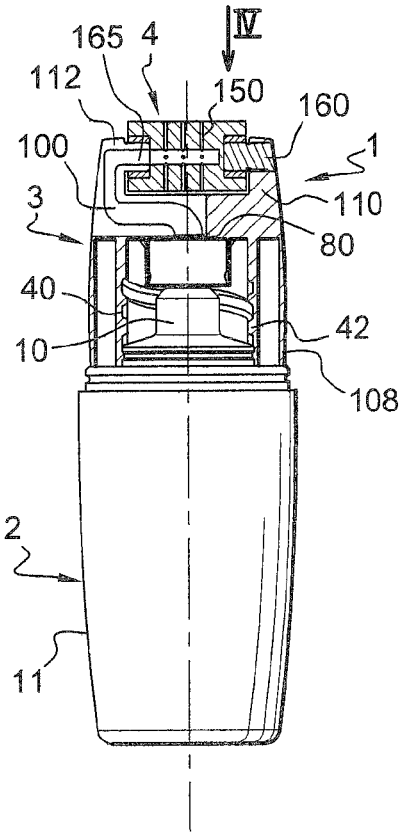
FIG. 3 is a view analogous to FIG. 1, drawn partially in longitudinal section in the applicator head.
Figure 4:
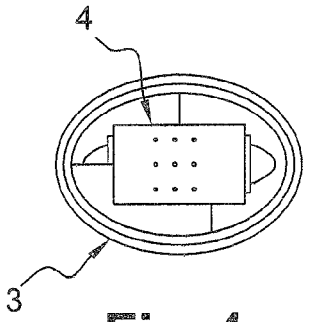
FIG. 4 is a plan view looking along IV of FIG. 3.

The packaging and applicator device 1 shown in the figures comprises a container 2 containing the composition for dispensing and an applicator head 3 secured to the container 2, and carrying, in the examples described, an applicator member 4 that is rotatable about an axis of rotation X, which axis extends, by way of example and as shown, perpendicularly to the longitudinal axis Y of the device.

In the example shown, the applicator member 4 is in the form of a roller, having a generally cylindrical outer surface of revolution about the axis X, however the applicator member 4 could present some other shape without that going beyond the ambit of the present invention, e.g. a spherical shape, possibly truncated at its ends, a biconical shape, an ellipsoidal shape, a diabolo shape, or some other possible shape. The applicator member may include spikes or other portions in relief on its surface, or in a variant it may have an outside surface that is smooth. The applicator member may be flocked, where appropriate. A relatively smooth outside surface may facilitate cleaning the applicator member.

The applicator member may be made of a material that is elastically deformable and not cellular, e.g. a silicone.

In the example shown, the device 1 has a single applicator member 4, however the configuration could be different, and the device 1 may in particular include a plurality of applicator members 4, all rotating about a common axis of rotation X, or in a variant about respective axes of rotation that are mutually parallel or intersecting, or indeed of orientations that are variable relative to one another.

The container 2 comprises an elongated body 10 along the axis Y in the example described, that is provided at its top portion with a neck 10. The body 11 has a flexible wall, thereby enabling a user pressing the body 11 to expel the composition through the neck 10 in order for it to be dispensed to the outside of the device.

The container 2 includes an enlargement 14 at the base of the neck 11, the enlargement being of section that is circular when taken perpendicularly to the axis Y. The enlargement 14 is provided with a portion in relief, e.g. an annular groove 15, serving to enable the applicator head 3 to be mounted on the container 2 by snap fastening, thereby retaining it on the container 2 without preventing it from turning relative thereto.

The body 11 of the container 2 also includes a shoulder 16 and a portion in relief, e.g. a groove 17, serving to enable a protective cap (not shown) for the applicator head 33 to be snap fastened thereon. By way of example, the body 11 is made by blow injection molding or blow extrusion, using a thermoplastic material, e.g. a polyolefin.

Figure 7:
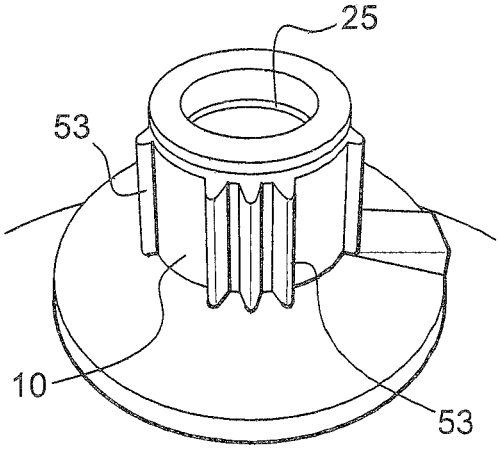
FIG. 7 is a diagrammatic and fragmentary perspective view showing the neck of the container.
Figure 12:
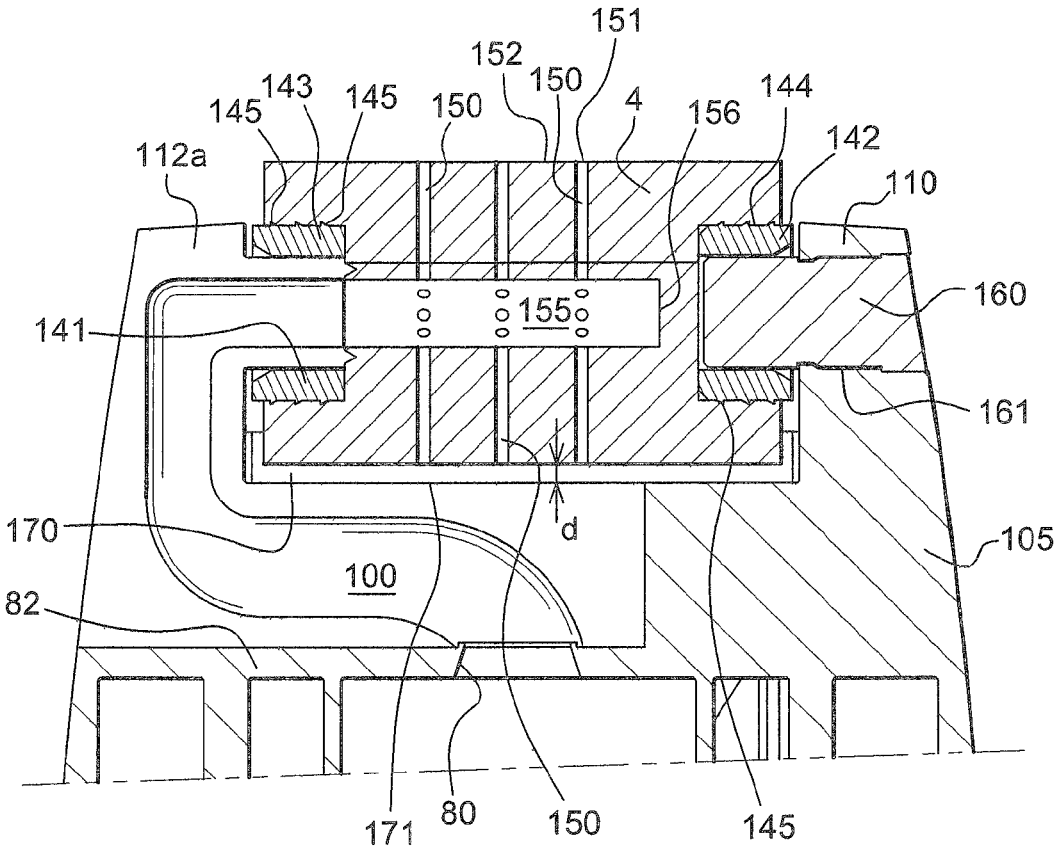
FIG. 12 is a fragmentary longitudinal section of the applicator head.
Figure 13:
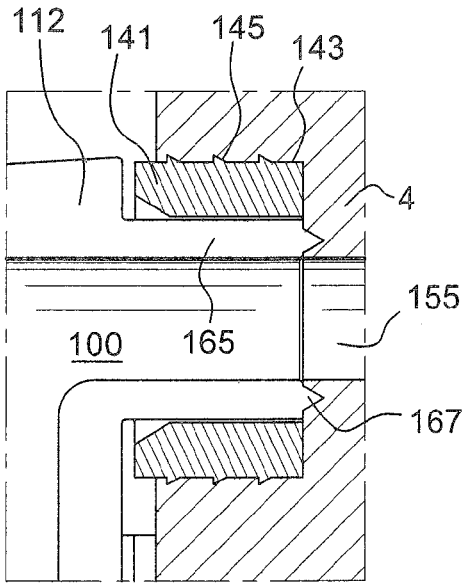
FIGS. 13 and 14 are section views showing implementation details of the applicator head.
Figure 14:
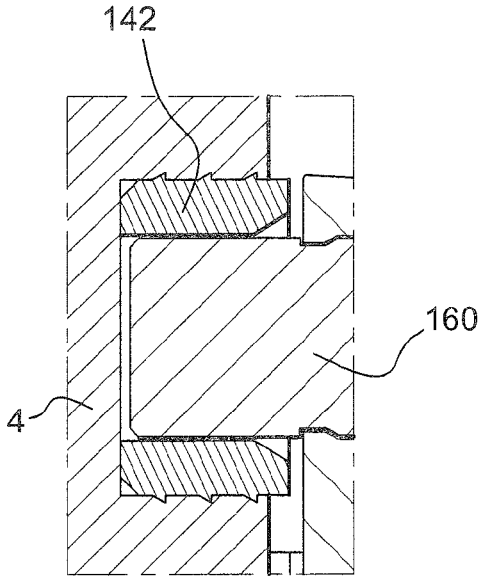

The neck 10 receives an insert 20 for performing a function that is explained below. The insert 20 has a collar 21 at one end, which collar bears against the top end of the neck 10, as can be seen in FIG. 7.

The insert 20 has a cylindrical body 23 engaged as a friction fit in the neck 10. An annular lip 25 projects from the inside surface of the body 23 of the insert.

Figure 17:
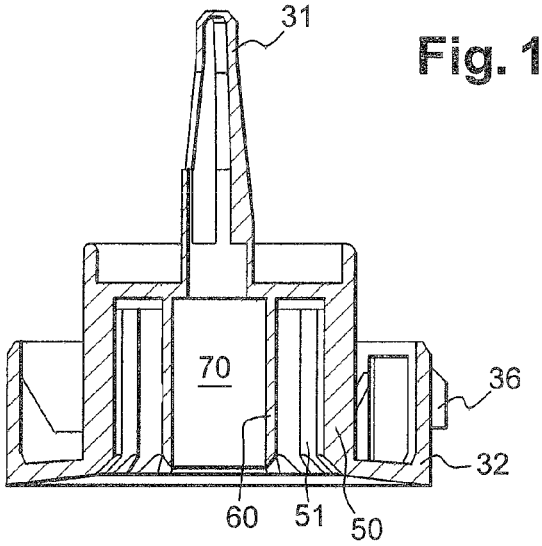
FIG. 17 is a longitudinal section view of the shutter.
Figure 15:
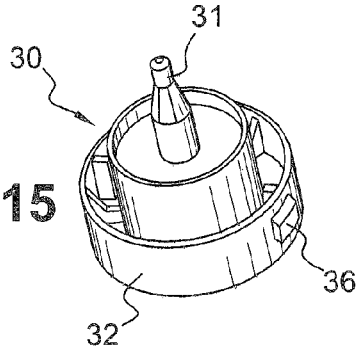
FIGS. 15 and 16 are perspective views of the shutter.
Figure 16:
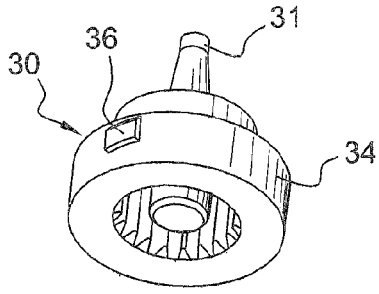

The applicator head 3 in the example described houses a shutter 30 that can be seen in isolation in FIGS. 15 to 17, the shutter being provided with a nozzle 31 and a base 32. At its periphery, the base has a tubular skirt 34 provided with studs 36 that are engaged in one or more threads 40 formed on the radially inside surface of an inner skirt 42 of the applicator head 3.

The shutter 30 includes a tubular upright 50 fitted with axially-extending splines 51 on its radially inner surface that engage with corresponding axially-extending splines 53 of the neck 10 of the container, such that the shutter 30 is free to slide relative to the neck 10 but not to turn relative thereto when the applicator head 3 is pivoted relative to the container 2 and the studs 36 move within the thread(s) 40.

The shutter 30 also has a sealing skirt 60 that is engaged in the neck 10 and that comes into contact with the lip 25 of the insert 20, thereby providing leaktight communication between the space 70 inside the shutter 30 and the space inside the container 2, even after the device has been used.

The nozzle 31 co-operates with a seat 80 formed within the applicator head 3 when the head is in a shutting position relative to the container 2 and the shutter 30 is in a high position relative to the applicator head 3. When the head is pivoted through half a turn relative to the container 2, the shutter moves downwards to occupy its low position and the nozzle 31 is disengaged from the seat 80, thereby allowing composition to pass from the space 70 inside the shutter towards an internal duct 100 made within the applicator head 3.

The duct 100 is connected to the opening defined by the seat 80 and extends between the applicator member and the wall 82 in which the seat 80 is made, thereafter turning through 180° so as to terminate at the applicator member 4.

Figure 5:
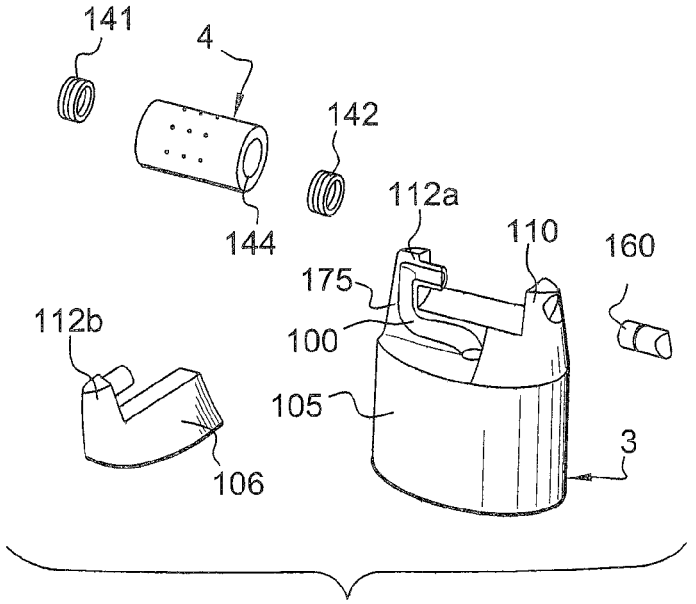
FIG. 5 is an exploded view of the applicator head.
Figure 10:
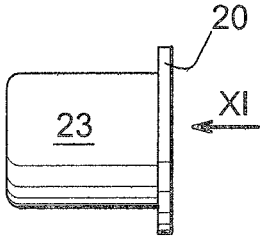
FIG. 10 shows the insert in isolation mounted in the neck of the container.
Figure 11:
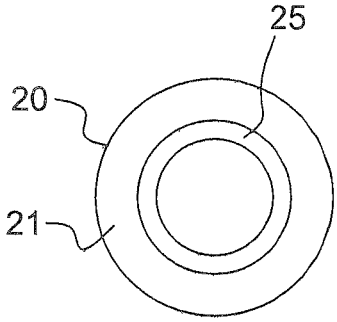
FIG. 11 is a view looking along XI of FIG. 10.
Figure 9:
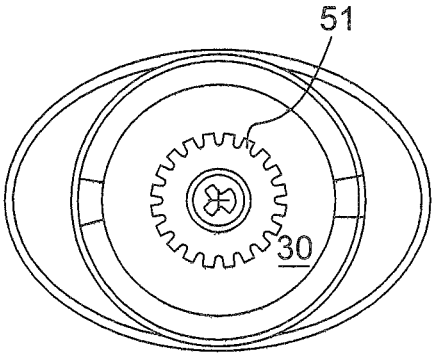
FIG. 9 is a view from beneath of the applicator head fitted with the shutter.
Figure 8:
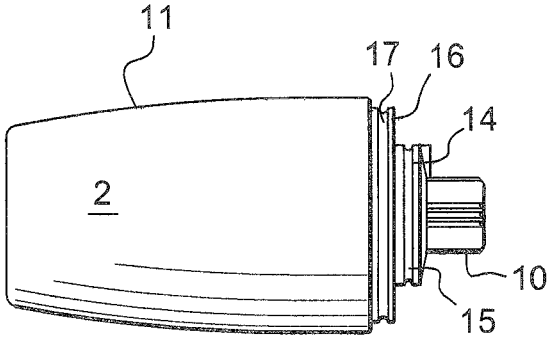
FIG. 8 shows the container in isolation and in face view.
Figure 6:
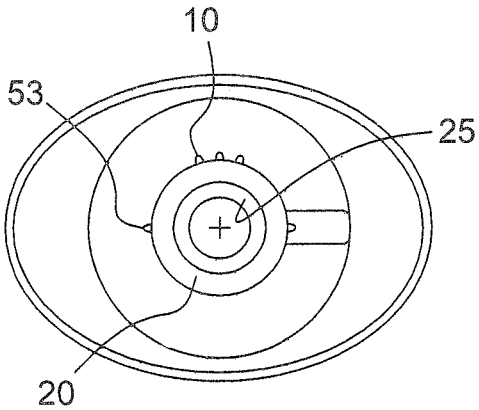
FIG. 6 shows the container of the device in isolation as seen from above.

As can be seen in FIG. 5 in particular, the duct 100 is formed between two parts 105 and 106 of the applicator head 3.

The part 105 includes the above-mentioned internal skirt 42 together with a covering skirt 108 that extends around the internal skirt 40.

The part 105 also has one of the uprights 110 between which the applicator member 4 turns together with half 112*a* of the other upright 112. The other part 106 has the other half 112*b* of the upright 112.

The applicator member 4 is mounted to rotate by means of two rings 141 and 142 that are fastened in respective housings 143 and 144 of the applicator member 4. As shown, each ring 141 or 142 may include anchor catches 145 e.g. of annular shape, and each ring may have a plurality of such catches, as shown.

The applicator member 4 has radial channels 150 opening out via dispenser orifices 151 into the radially outer surface 152 of the applicator member 4.

The channels 150 open out internally in a central housing 155 that is blind, being defined at its end remote from the housing 143 by an end wall 156.

The ring 142 is free to turn on a piece of shaft 160 fastened in an opening 161 in the upright 110, e.g. by snap fastening. The ring 141 turns on an endpiece 165 made up of two halves forming portions respectively of the parts 105 and 106. The endpiece 165 includes an annular sealing rib 167 at its free end, the rib engaging against the end wall of the housing 143 so as to provide leaktight communication between the duct 100 and the blind housing 155.

In order to put the applicator member 4 into place on the applicator head, the ring 141 is initially engaged on the endpiece 165, and then the piece of shaft 160 is put into place on the upright 110.

The housing 170 of the applicator head 3 extending between the uprights 110 and 112 may have an end wall 171 e.g. in the form of a portion of a cylindrical surface that extends at a short distance d from the surface of the applicator member 4, so as to limit the quantity of composition that is capable of accumulating between the end wall 171 and the applicator member 4.

The parts 105 and 106 may be assembled together by any appropriate means, in particular by ultrasound welding and/or adhesive, or even by snap fastening.

Each of the parts 105 and 106 may present an assembly face 175, and each of the portions of the duct 100 made within the parts 105 and 106 may be recessed relative to the corresponding assembly face 175.

In embodiments, the dispenser orifices 151 are small enough at rest to avoid the composition flowing under gravity.

The diameter of the orifices 151 may be selected as a function of the rheology of the composition. By way of example, the orifices 151 are made by perforating the applicator member 4 after it has been expanded mechanically, e.g. by axial and/or radial elongation, such that on the applicator member 4 returning by elastic deformation to its initial shape, the diameter of the orifices decreases. By way of example, the diameter of the orifices 151 at rest is less than 1 mm, better less than 0.75 mm, e.g. lying in the range 0.4 mm to 0.6 mm. By way of example, the length of the channels 150 may lie in the range 1 mm to 20 mm.

In variant embodiments, the orifices 151 are permanently open.

In order to dispense the composition, the user presses on the flexible wall of the body 11 of the container 2, after bringing the shutter head into its open position, thereby causing the composition to flow via the internal duct 100 and escape via the orifices 151, after the material of the applicator member 4 has expanded locally. The user can monitor the quantity of composition delivered to the surface of the applicator member by eye prior to relaxing pressure on the body 11.

After use, the applicator head is returned to its shut position. The applicator member 4 may be rinsed under running water, where appropriate.

Figure 18A:
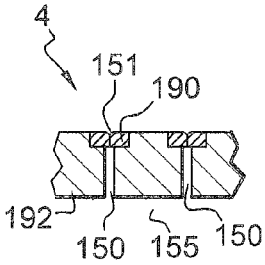
FIGS. 18A and 18B show details of a first variant embodiment of the applicator member.

In the variant shown in FIG. 18A, the outlet orifices for the composition 151 are defined by valves 190, e.g. fitted on the body 192 of the applicator member 4.

Figure 18B:
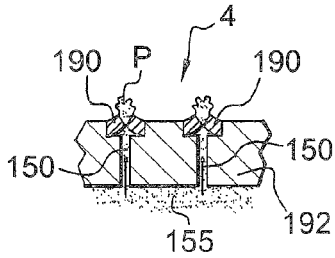

The valves 190 are capable of opening under the pressure of the composition P, as shown in FIG. 18B.

By way of example, the valves 190 are split in their centers, e.g. having a through slit in the form of a cross or a single slit, with optionally touching edges, or they may be pierced by orifices suitable for enlarging under the effect of pressure from the composition.

The valves 190 may be fastened by any appropriate manner to the body 192 of the applicator member 4, e.g. by snap fastening, welding, or adhesive. The valves 190 may also be overmolded onto the body 192 of the applicator member.

The invention is not limited to a particular shape for making the valves.

Figure 19:
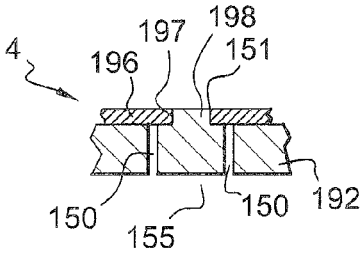
FIG. 19 is a detail view of another variant embodiment of the applicator member.

In the variant shown in FIG. 19, the body 192 of the applicator member 4 is covered by an outer membrane 196 that is elastically deformable. This membrane includes openings 197 that are closed by studs 198 on the body 192, these studs 198 co-operating with the openings 197 in the membrane 196 to define the dispenser orifices 151. When the composition is under pressure, the membrane 196 is capable of lifting off the body 192 and the composition then flows through the orifices 151 formed between the studs 198 and the openings 197.

Figure 21:
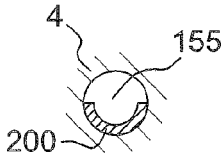
FIG. 21 is a section view on XXI-XXI of FIG. 20.
Figure 20:
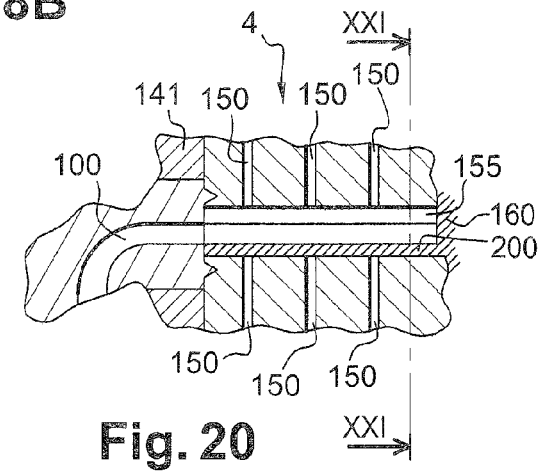
FIG. 20 is a diagrammatic and fragmentary view of a variant applicator head.

The applicator head 3 may include an extension 200 that extends inside the housing 155 of the applicator member, e.g. being integrally molded with the piece of shaft 160, as shown in FIGS. 20 and 21.

In such an embodiment, the housing 155 may open out into the housing 144 so as to enable the extension 200 to be inserted into the housing 155 when the piece of shaft 160 is inserted through the upright 110.

The piece of shaft 160 may include keying means serving to ensure that the extension 200 is placed in the bottom portion of the housing 155, i.e. beside the end wall 171 of the housing 170.

The extension 200 may be adapted to close the channels 150 that open out in register with the end wall 171, or at least to reduce the flow of composition via said channels. This encourages the composition to flow via the orifices 151 that are situated on the surface of the applicator member 4 that is directly accessible to the user.

The angular extent of the extension 200 around the axis of rotation of the applicator member 4 may be selected as a function of the number of channels 150 to be closed, and by way of example, and as shown in FIG. 21, the extension 200 extends over substantially half a revolution, e.g. on either side of a midplane containing the longitudinal axis of the device.

In the previously described exemplary embodiments, the dispenser orifices are on the outside of the applicator member, being visible by the user of the device.

It is possible, in a variant embodiment of the invention, to make the dispenser orifices so they are within the applicator member, located for instance under a layer of flocking or porous material, e.g. a cellular material.

Figure 22:
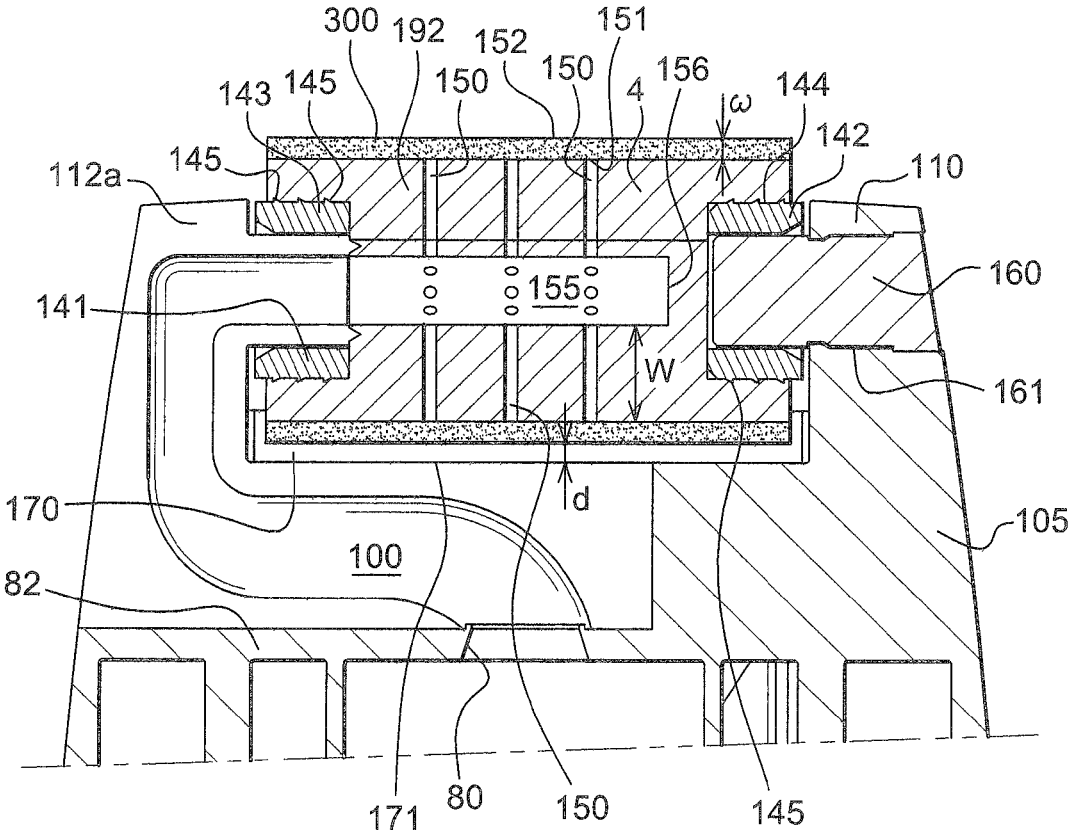
FIG. 22 is a view analogous to FIG. 12, of a variant embodiment.

By way of example, FIG. 22 shows a device in which the applicator member 4 comprises a body 192 and an external sleeve 300. The body 192 is crossed by channels 150 which open out by dispenser orifices 151 at the interface between the body 192 and the sleeve 300, such a sleeve being made, for instance, of an open cells foam.

The thickness w of the sleeve 300 is, for example, less than the thickness W of the body 192, such that, for example, $W/w \geq 2$.

When the composition contained in the container is not under pressure, the channels 150 have a cross section small enough to avoid flowing of the product from the central housing 155 to the orifices 151.

When the composition is put under pressure, channels 150 are able to dilate and enable composition to flow through the orifices 151 and therefore to spread into and onto the surface of the sleeve 300.

In another embodiment not shown, the sleeve 300 is replaced by a flocking.

In a variant embodiment not shown, the orifices 151 are replaced by one of those described relatively to FIG. 18A, 18B or 19, the valves represented in these figures being then located under the sleeve 300.

If necessary, recesses are present directly above the valves to facilitate their openings, these recesses being made onto the radially interior face of the sleeve.

Naturally, the invention is not limited to the examples described.

By way of example, the shape of the applicator member may be modified. The composition contained in the container may be any cosmetic or dermatological liquid composition, in particular a makeup or care product.

The shutter may be made other than as shown and it may be actuated by moving the applicator head axially relative to the container rather than by moving it in rotation. The device may also be made without a shutter, the inside space of the applicator member being permanently in communication with the supply of composition.

The expression "comprising a" should be understood as being synonymous with "comprising at least one".

What is claimed is:

1. A device for packaging and applying a liquid composition, the device comprising:

a container containing the composition; and an applicator head connected to the container and comprising a rotary applicator member having at least one dispenser orifice configured to open when the upstream composition is put under sufficient pressure, and to close when the pressure decreases, wherein the applicator member includes at least one channel communicating with the dispenser orifice and opening out into a cavity of the applicator member, the cavity being distinct from the container.

2. A device according to claim 1, wherein the or each orifice is defined by a hole through an elastically deformable wall, the section of the hole being small enough, when not deformed, to oppose the composition flowing therethrough under gravity.

3. A device according to claim 2, wherein the diameter of the orifice(s) at rest is less than or equal to 1 mm, in particular lying in the range 0.4 mm to 0.6 mm.

4. A device according to claim 1, wherein the or each orifice is fitted with a valve.

5. A device according to claim 1, wherein the number of orifices lies in the range 3 to 50.

6. A device according to claim 1, wherein the at least one orifice extend solely in a middle region of the applicator member.

7. A device according to claim 1, including orifices disposed in annular rows.

8. A device according to claim 1, wherein the applicator member turns between two uprights of an applicator head.

9. A device according to claim 1, wherein the applicator member includes a blind housing into which there opens out at least one radial channel communicating with an orifice.

10. A device according to claim 1, wherein the container presents a flexible wall enabling the composition contained therein to be subjected to pressure.

11. A device according to claim 1, including an extension that is fastened relative to the container, the extension extending inside the applicator member and being configured to close channels feeding the at least one orifice with composition, the extension having a predefined orientation relative to the container.

12. A device according to claim 1, wherein the applicator member is carried by an applicator head that is turnable relative to the container.

13. A device according to claim 12, wherein movement of the applicator head relative to the container causes a shutter to move, causing it to pass from a shut state closing communication between the at least one orifice and the container to an open state, and vice versa.

14. A device according to claim 1, wherein the applicator member is fed with composition by a duct that is formed, at least over a fraction of its length, by assembling together at least two parts.

15. A device for packaging and applying a liquid composition, the device comprising:

a container containing the composition; and a rotary applicator member having at least one dispenser orifice configured to open when an upstream composition is put under sufficient pressure, and to close when the pressure decreases, wherein:

the applicator member is carried by an applicator head that is turnable relative to the container, movement of the applicator head relative to the container causes a shutter to move, causing it to pass from a shut state closing communication between the at least one orifice and the container to an open state, and vice versa, the shutter is provided at a base with a tubular skirt comprising studs that are engaged in one or more threads formed on a radially inside surface of an inner skirt of the applicator head, and the shutter includes a tubular upright fitted with axially-extending splines on the radially inner surface that engage with corresponding axially-extending splines of a neck of the container, such that the shutter is free to slide relative to the neck but not to turn relative thereto when the applicator head is pivoted relative to the container and the studs move within the one or more threads.

16. A device for packaging and applying a liquid composition, the device comprising:

a container containing the composition; and a rotary applicator member having at least one dispenser orifice configured to open when an upstream composition is put under sufficient pressure, and to close when the pressure decreases, wherein:

the applicator member is fed with composition by a duct that is formed, at least over a fraction of its length, by assembling together at least two parts, the duct has over the fraction a cross section having an outline defined by at least the two parts, and each of the parts are stationary relative to the other part at any time during the service life of the device.

* * * * *